United States Patent [19]

Skinner

[11] 4,074,667

[45] Feb. 21, 1978

[54] LIQUID FUEL INJECTION PUMPING APPARATUS

[75] Inventor: Robert Thomas John Skinner, High Wycombe, England

[73] Assignee: C.A.V. Limited, Birmingham, England

[21] Appl. No.: 735,524

[22] Filed: Oct. 26, 1976

Related U.S. Application Data

[63] Continuation of Ser. No. 595,426, July 14, 1975, abandoned.

[30] Foreign Application Priority Data

July 19, 1974 United Kingdom ..... 32019/74

[51] Int. Cl.[2] ..... F02M 59/20

[52] U.S. Cl. ..... 123/139 AQ; 417/462

[58] Field of Search ..... 123/139 AD, 139 AR, 123/139 AP, 139 AE, 139 AQ; 417/462

[56] References Cited

U.S. PATENT DOCUMENTS

| | | | |
|---|---|---|---|
| 2,910,975 | 11/1959 | Evans | 123/139 AQ |
| 3,394,688 | 7/1968 | Roosa | 123/139 AQ |
| 3,439,624 | 4/1969 | Glikin et al. | 123/139 AE |
| 3,552,366 | 1/1971 | Kemp | 123/139 AQ |
| 3,897,764 | 8/1975 | Bakti | 123/139 AQ |

*Primary Examiner*—Charles J. Myhre
*Assistant Examiner*—David D. Reynolds

[57] ABSTRACT

A fuel injection pumping apparatus includes an injection pump driven in timed relationship with an associated engine and a resiliently loaded fluid pressure operable member for controlling the timing of delivery of fuel by the injection pump. Means is provided for generating a pressure responsive to the speed of and/or load on the associated engine an this pressure is applied to the aforesaid member so that the timing of delivery of fuel is variable. The apparatus also includes a piston movable to adjust the force exerted by the resilient means on the member and valve means is provided for controlling the application of fluid pressure to said piston, the valve means being responsive to the speed of operation of the associated engine.

3 Claims, 2 Drawing Figures

LIQUID FUEL INJECTION PUMPING APPARATUS

This is a continuation of application Ser. No. 595,426 filed July 14, 1975 now abandoned.

This invention relates to liquid fuel injection pumping apparatus for supplying fuel to internal combustion engines, and of the kind comprising an injection pump adapted to be driven in timed relationship with an associated engine, a resiliently loaded fluid pressure operable member for controlling the timing of delivery of fuel to the associated engine and means for generating a pressure responsive to the speed of and/or load on the associated engine, said pressure being applied to said member whereby the timing of the delivery of fuel will be dependent upon the speed of and/or the load on the associated engine.

The object of the invention is to provide such an apparatus in a simple and convenient form.

According to the invention, an apparatus of the kind specified comprises a piston movable to adjust the force exerted by said resilient means on said fluid pressure operable member, and valve means for controlling the application of fluid pressure to said piston, said valve means being responsive to the speed of operation of the associated engine.

Two examples of apparatus in accordance with the invention will now be described with reference to FIGS. 1 and 2 of the accompanying drawings respectively, the Figures being in diagrammatic form.

Figure 1:
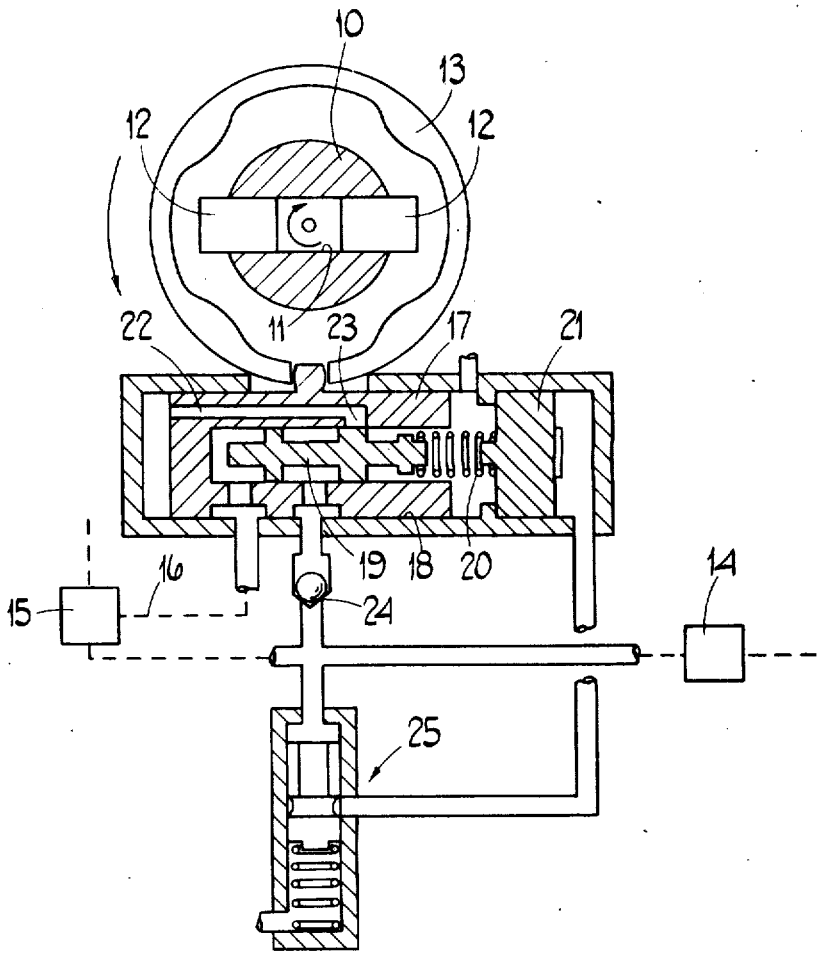

Referring to FIG. 1 of the drawings, the apparatus comprises a rotary distributor member 10 which is adapted to be driven in timed relationship with the associated engine. The distributor member is mounted within a body part, and formed in the distributor member is a transversely extending bore 11 in which are mounted a pair of pumping plungers 12. The plungers 12 are adapted to be moved inwardly as the distributor member rotates, by means of cam lobes formed on the internal periphery of an angularly adjustable cam ring 13 which is mounted in the body part of the apparatus. Conveniently rollers carried by shoes are provided between the plungers and the cam lobes. The portion of the bore 11 between the plungers 12 constitutes the pumping chamber of the injection pump, and in known manner, fuel displaced from this bore during inward movement of the plungers is delivered through a passage formed in the distributor member, to a delivery passage which is in register with a delivery port formed in the body part, during the time when the plungers are being moved inwardly. During the filling stroke of the injection pump, fuel is delivered to the bore 11, and conveniently this fuel is obtained from a feed pump 14, the quantity of fuel being determined by a throttle valve 15 including a manually adjustable member so that the speed of the associated engine can be varied as required by the operator. The member 15 also produces a control pressure which appears in a passage 16, in the particular example, the control pressure being dependent upon the speed of and the load on the associated engine. Moreover, the output pressure of the feed pump 14 is controlled by a valve so that it varies in accordance with the speed at which the associated engine is operating. In some instances, it can be made to vary in accordance with the square of the speed.

The angular setting of the cam ring 13 determines the timing of delivery of fuel to the associated engine, and for adjusting the angular setting, a piston 17 is provided and which is contained within a cylinder 18. The piston 17 is provided with a cylindrical bore in which is located a fluid pressure operable member in the form of a servo valve 19, one end of the servo valve is exposed to the control pressure in the passage 16, whilst the other end of the servo valve is contacted by resilient means in the form of a coiled compression spring 20. The other end of the spring 20 engages with a piston 21 which is mounted within an extension of the cylinder 18. Moreover, intermediate the cylinder and the extension thereof, is a stop whereby the extent of movement of the piston 21 is limited.

Formed within the piston 17 is a passage 22 which extends to the end of the piston 17 remote from the piston 21, and the passage 22 opens into a port 23 positioned to be covered by a land of the valve 19. The valve 19 is provided with a further land, and the annular groove defined between the two lands is in communication with the outlet of the feed pump 14 by way of an anti-shock valve 24. In operation, as the control pressure varies, the position of the valve 19 will also vary, and if for instance the valve moves towards the right as seen in FIG. 1, then the port 23 will be exposed to the groove on the valve 19 and fuel under pressure from the outlet of the feed pump will flow along the passage 22. As a result, the piston 17 will move towards the right, thereby effecting anticlockwise movement of the ring 13, thereby serving to advance the timing of delivery of fuel to the engine. Conversely, if the control pressure in the passage 16 should fall, then the valve 19 moves towards the left and the port 23 is exposed to a drain and in this case, the reaction of the cams and rollers effects clockwise movement of the ring 13 and movement of the piston 17 towards the left. Such movement occurs until the port 23 is again covered by the land of the valve.

Also provided is a valve 25 which controls the application of fluid under pressure from the outlet of the feed pump 14, to the piston 21. As shown, the valve 25 is in the open position so that direct communication exists between the outlet of the feed pump and the piston. As a result of this the piston 21 is moved its maximum extent to increase the force exerted by the spring 20 upon the valve 19. The valve 25 includes a spring loaded valve element which is subjected to the outlet pressure of the feed pump, and at idling and low speeds, the outlet pressure of the feed pump is insufficient to overcome the spring loading of the valve element. As a result, the valve 25 is closed, and the piston 21 moves towards the right under the action of the spring 20 thereby reducing the force exerted by the spring upon the valve. The effect of this is that the shape of the advance curve is modified for low engine speeds.

Figure 2:
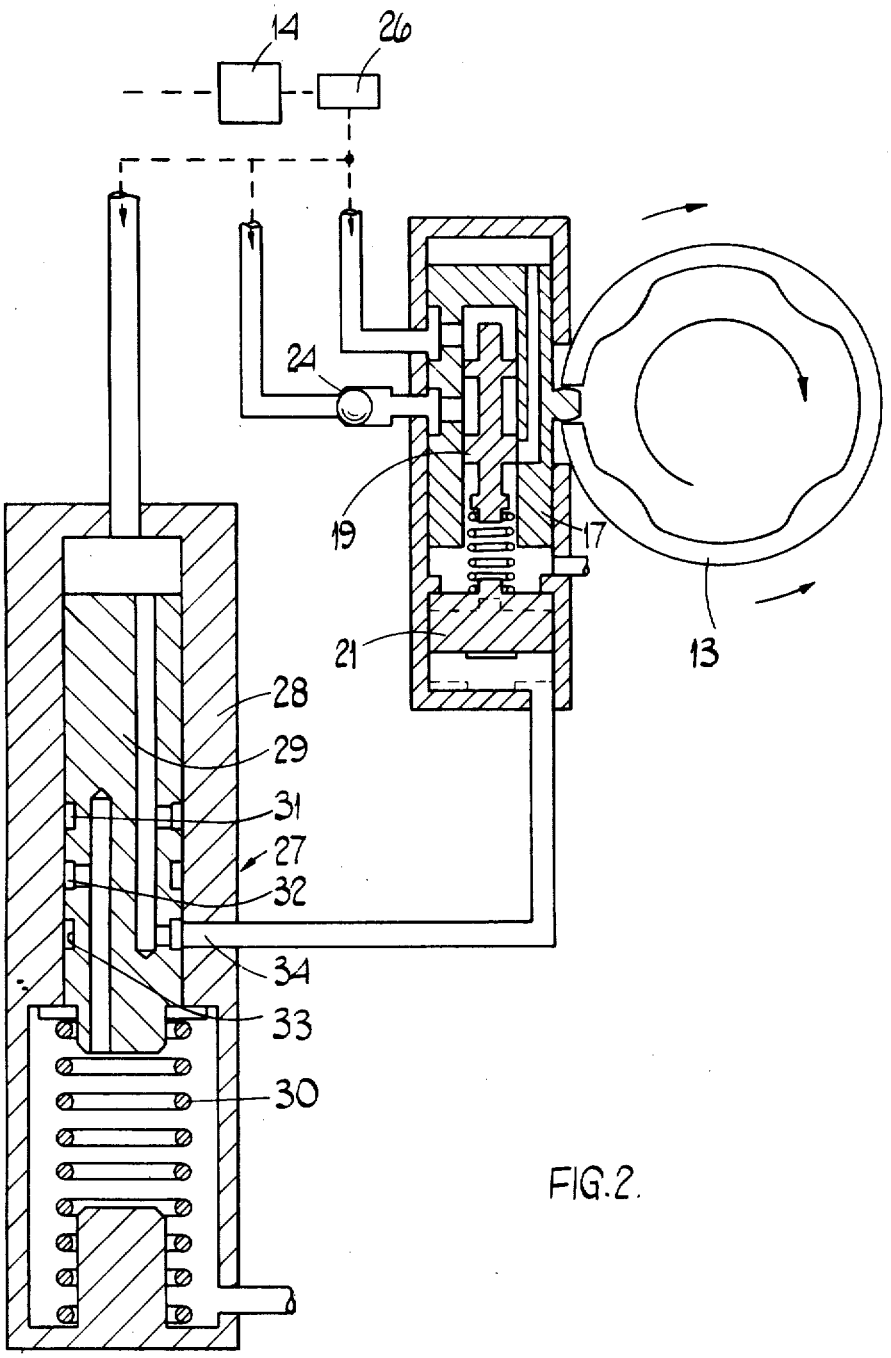

Turning now to FIG. 2, identical reference numerals to those used in FIG. 1 are used wherever possible. In this case, a valve 26 is associated with the feed pump 14, and this valve provides a pressure which varies as the square of the speed at which the apparatus is driven. This pressure is applied to the valve member 19 whilst the normal outlet pressure of the feed pump is applied by way of the anti-shock valve 24 to the groove on the valve member 19. The piston 17 operates in the same way, and a valve 27 is provided to determine the pressure which is applied to the piston 21. As shown, the valve 27 comprises a valve body 28 in which is defined a cylindrical chamber, one end of which communicates with the outlet of the valve 26 whilst the other and enlarged end of the chamber communicates with a drain. Slidably mounted within the narrower portion of the chamber, is a valve member 29 and a coiled compression spring 30 is provided in the enlarged portion of the chamber, and acts upon the valve member 29.

Formed in the valve member 29 are three axially spaced grooves 31, 32 and 33, the groove 32 being the central groove and being connected by way of a passage within the valve member, with the end of the chamber containing the spring. The other two grooves are interconnected with each other, and with the narrower end of the chamber. Moreover, formed in the body 28 is a port 34 with which the grooves can register, and the port 34 is connected to the cylinder containing the piston 21. When the pressure applied to the valve member 29 is such that the force is less than the preload of the spring 30, the groove 33 will be in register with the port 34 so that fuel under pressure from the valve 26 will be applied to the piston 21 and the piston will assume the position in which it is shown. As the pressure increases, however, the valve member 29 will move against the action of the spring 30, and the groove 32 brought into register with the port 34. When this occurs, the pressure to which the piston 21 is exposed is a drain pressure so that the piston 21 will move under the action of the force exerted by the spring disposed between the piston 21 and the valve 19, so that it assumes the dotted position shown in FIG. 2. As the pressure further increases, the groove 31 will be brought into register with the port 34, and the position of the piston 21 will revert to that which is shown in full outline in FIG. 2. If desired, however, the groove 31 may be omitted so that there will be no reversion of the position of the piston 21.

In an alternative arrangement the grooves 31 and 33 are connected to the drain whilst the groove 32 is connected to the outlet of the valve 26, but again the groove 31 may be omitted. With this arrangement, the piston 21 will remain in the dotted outline position until the valve member 29 has moved sufficiently to bring the groove 32 in register with the port 34, and it will stay in this position until further movement of the valve 29 occurs.

By using the valve and piston as described an appreciable modification can be made to the timing characteristic over a narrow range of engine speeds the various examples described illustrate that such modification can be achieved in a very simple manner,.

I claim:

1. A liquid fuel injection pumping apparatus for supplying fuel to an internal combustion engine comprising an injection pump adapted to be driven in timed relationship with an associated engine, a fluid pressure operable member for controlling the timing of delivery of fuel to the associated engine, means for generating a fluid pressure responsive to an operating characteristic of the associated engine, conduit means through which said pressure is applied to said member, resilient means loading said member against the action of the fluid pressure, a pressure responsive piston forming an abutment for said resilient means, said piston being movable from a first to a second position when pressure is applied thereto as to vary the force exerted by said resilient means on said member, a pressure responsive valve for controlling the application of pressure to said piston, said valve comprising a valve cylinder, a valve element movable in said cylinder, a port in the wall of said valve cylinder, further conduit means for communicating the pressure at said port to said pressure responsive piston, resilient means biasing said valve element to one end of said cylinder, a pair of axially spaced grooves on said valve element, a pair of passages through which said grooves communicate with the opposite ends of the valve cylinder respectively, passage means communicating the other end of said valve cylinder with the means generating said fluid pressure so that the valve element moves in response to variations in said fluid pressure, and further passage means through which said one end of the cylinder communicates with a drain, said valve element acting depending on its position, to place said port in communication with one or the other end of said valve cylinder.

2. An apparatus according to claim 1, including an additional groove on said valve element, said additional groove being axially spaced on one side of said pair of grooves, and a further passage connecting said additional groove to the remote one of said pair of grooves.

3. An apparatus according to claim 2, in which said passages and further passage are formed in the valve element.

* * * * *